US008122608B2

(12) United States Patent
Deien

(10) Patent No.: US 8,122,608 B2
(45) Date of Patent: Feb. 28, 2012

(54) REAR SIGHT FOR AN ARCHERY BOW

(76) Inventor: Melvin Deien, Breese, IL (US)

( * ) Notice: Subject to any disclaimer, the term of this patent is extended or adjusted under 35 U.S.C. 154(b) by 353 days.

(21) Appl. No.: 12/612,219

(22) Filed: Nov. 4, 2009

(65) Prior Publication Data

US 2010/0107430 A1 May 6, 2010

Related U.S. Application Data

(60) Provisional application No. 61/111,116, filed on Nov. 4, 2008.

(51) Int. Cl.
*F41G 1/00* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS

| | | | | | |
|---|---|---|---|---|---|
| 2,642,661 | A | | 6/1953 | Fredrickson, B. | |
| 2,959,860 | A | * | 11/1960 | Kowalcyk | 33/265 |
| 3,777,380 | A | | 12/1973 | Theodore | |
| 3,945,127 | A | | 3/1976 | Spencer | |
| 4,020,560 | A | * | 5/1977 | Heck | 33/265 |
| 4,177,572 | A | | 12/1979 | Hindes | |
| 4,195,414 | A | | 4/1980 | Robinson | |
| 4,220,983 | A | | 9/1980 | Schroeder | |
| 4,325,190 | A | | 4/1982 | Duerst | |
| 4,521,972 | A | | 6/1985 | Larson | |
| 4,620,372 | A | | 11/1986 | Goodrich | |
| 4,915,088 | A | | 4/1990 | Powers | |
| 4,982,503 | A | | 1/1991 | Land | |
| 5,048,193 | A | | 9/1991 | Hacquet | |
| 5,303,479 | A | | 4/1994 | Rudovsky | |
| 5,367,780 | A | * | 11/1994 | Savage | 33/265 |
| 5,414,936 | A | * | 5/1995 | Sappington | 33/265 |
| 5,435,068 | A | | 7/1995 | Thames et al. | |
| 5,579,752 | A | | 12/1996 | Nelson et al. | |
| 5,619,801 | A | | 4/1997 | Slates | |
| 5,630,279 | A | | 5/1997 | Slates | |
| 5,632,091 | A | * | 5/1997 | Brion et al. | 33/265 |
| 5,634,278 | A | | 6/1997 | London | |
| 5,657,740 | A | * | 8/1997 | Slates et al. | 124/87 |
| 5,718,215 | A | * | 2/1998 | Kenny et al. | 124/87 |
| 5,735,053 | A | | 4/1998 | McGunigal | |
| 5,802,726 | A | | 9/1998 | Trosper, Jr. et al. | |
| 5,836,294 | A | | 11/1998 | Merritt | |
| RE36,266 | E | * | 8/1999 | Gibbs | 33/265 |
| 6,026,799 | A | | 2/2000 | Wiseby et al. | |
| 6,035,539 | A | | 3/2000 | Hollenbach et al. | |
| D423,627 | S | | 4/2000 | Simpson, Sr. | |
| 7,275,327 | B2 | | 10/2007 | Deine | |
| 2002/0017027 | A1 | | 2/2002 | Beshires | |

* cited by examiner

*Primary Examiner* — G. Bradley Bennett
*Assistant Examiner* — Tania Courson
(74) *Attorney, Agent, or Firm* — Polster, Lieder, Woodruff & Lucchesi, L.C.

(57) ABSTRACT

A rear sight for archery bows. The rear sight is adjustable to the archer's aiming, non-dominant eye and dominant shooting hand. The sight comprises a mounting bracket, a forward sight positioner, a rear sight positioner, a sight assembly and a light assembly. The mounting bracket and rear sight positioner are configured for selective choosing by the archer to use an aiming eye of the archer in conjunction with an oppositely matched shooting hand. In particular, the sight allows the archer to manipulate the rear sight positioner for left eye/right hand or right eye/left hand handling of the bow for subsequent alignment of the sight with the forward sight.

10 Claims, 6 Drawing Sheets

REAR SIGHT FOR AN ARCHERY BOW

CROSS-REFERENCE TO RELATED APPLICATIONS

This application claims priority under 35 U.S.C. §119(e) to U.S. Provisional Patent Application No. 61/111,116 filed Nov. 4, 2008 and entitled "BOW SIGHT SYSTEM" and is incorporated herein by reference.

STATEMENT REGARDING FEDERALLY SPONSORED RESEARCH

Not Applicable.

BACKGROUND

The present disclosure relates to a rear sight for archery bows, and more particularly, relates to an archery bow sight that is adjustable to the archer's aiming eye and dominant hand. The sight of the disclosure works in conjunction with a front mounted sight, such as a pin sight, which is used in aiming of an arrow to be released from the bow toward a target.

On a compound bow, pin sights mount forward of the bow and away from the archer when the archer holds the bow handle. The archer uses a rear sight to align with the forward pin sight. In particular, the rear sight mounts to the bow handle in a spaced relation from the forward pin sight such that the archer aligns the rear sight with the forward pin sight to sight the target.

A majority of archers are either right eye and right hand dominant or left eye and left hand dominant. Accordingly, rear sights are configured to accommodate the right eye/right hand or left eye/left hand dominant archer. For an archer, the dominant eye remains open to aim and the dominant hand grasps the bow string to release the arrow Some archers, however, due to an injury or due to a degenerative condition to their dominant eye, become oppositely matched with respect to their dominant hand. Due to the injury or condition, the archer may become a right eye and left hand shooter or may become a left eye and right hand shooter. These impaired archers are not able to effectively use existing rear sights since existing sights accommodate the same side dominance of the majority of archers. Thus, the archer with an opposite eye/hand dominance has to learn to shoot with their non-dominant hand to accommodate the eye dominance switch or has to give up the sport of archery.

SUMMARY

The sight comprises a mounting bracket, a forward sight positioner, a rear sight positioner, a sight assembly and a light assembly. The mounting bracket and rear sight positioner are configured for selective choosing by the archer to use an aiming eye of the archer in conjunction with an oppositely matched shooting hand. In particular, the sight allows the archer to manipulate the rear sight positioner for left eye/right hand or right eye/left hand handling of the bow for subsequent alignment of the sight with the forward sight.

BRIEF DESCRIPTION OF THE SEVERAL VIEWS OF THE DRAWINGS

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

The present disclosure relates to an archery sight. The sight can be used for aligning any appropriate arrow on a bow. However, for purposes of illustration only, the sight will be described as incorporating a rear sight for a compound bow. The sight may comprise a variety of materials. Further, components of the sight can have a variety of cross sectional shapes such as elliptical, oval, circular, triangular, square, rectangular or other appropriate configuration. The sight can be of any size to accommodate archers of any size; to accommodate right sighted or left sighted archers and to accommodate compound bows of any size or configuration. The sight of U.S. Pat. No. 7,275,327 is incorporated herein in its entirety.

Figure 1:
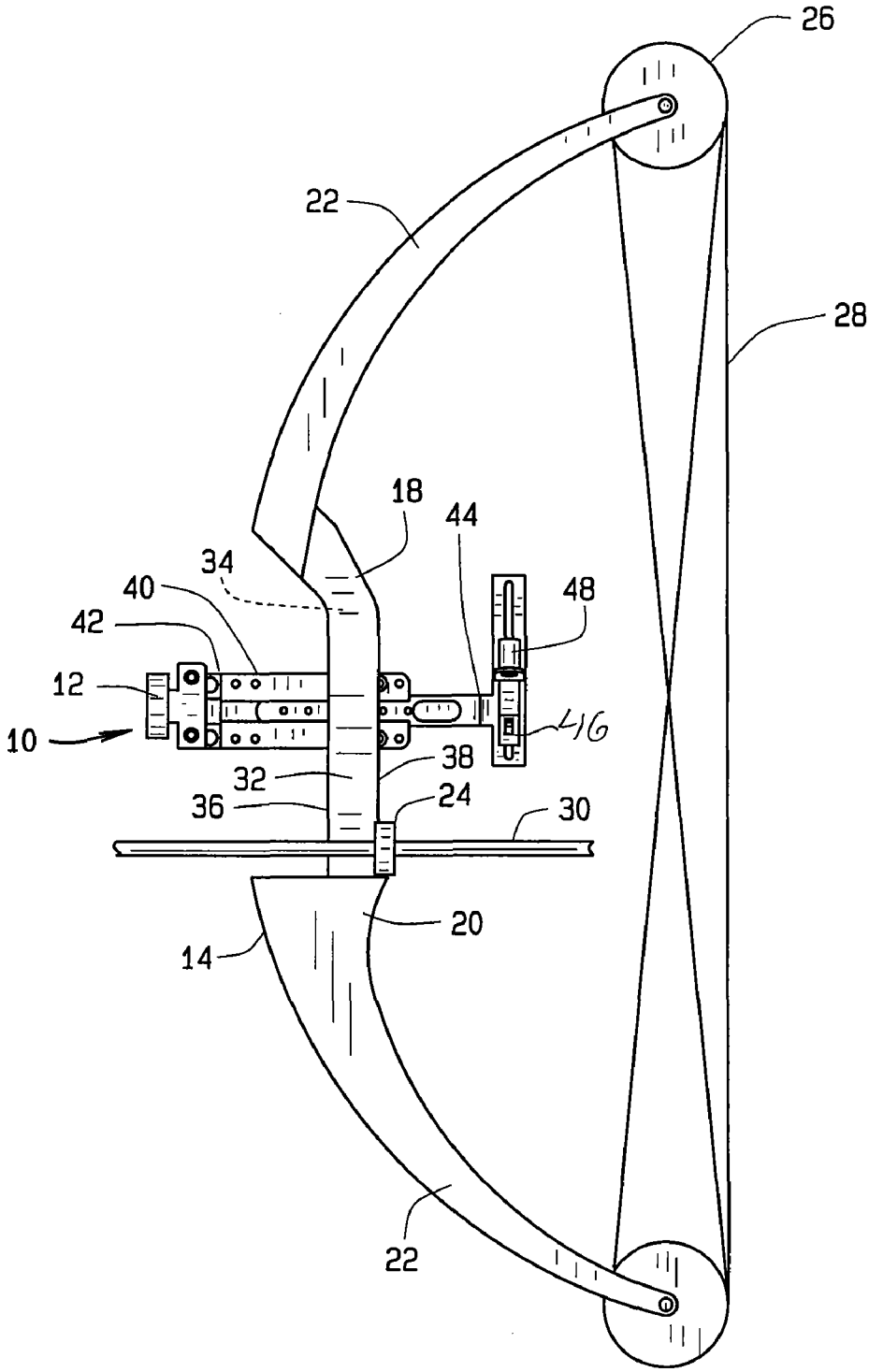
FIG. 1 illustrates a side elevational view of the sight of the present disclosure attached to a compound bow.
Figure 4:
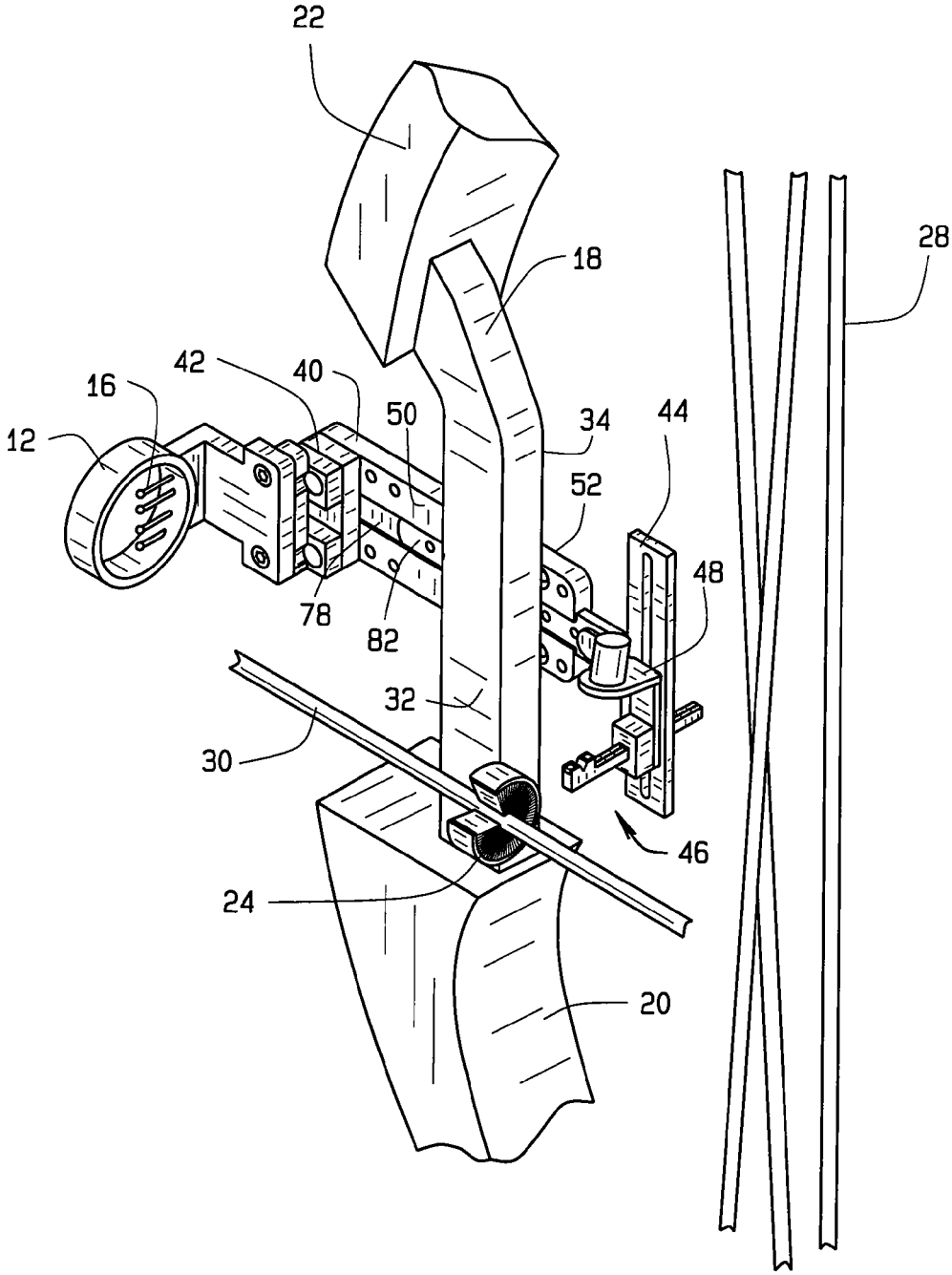
FIG. 4 is a partial perspective view of the sight of FIG. 2 connected to a riser of the compound bow.
Figures 7, 8A:
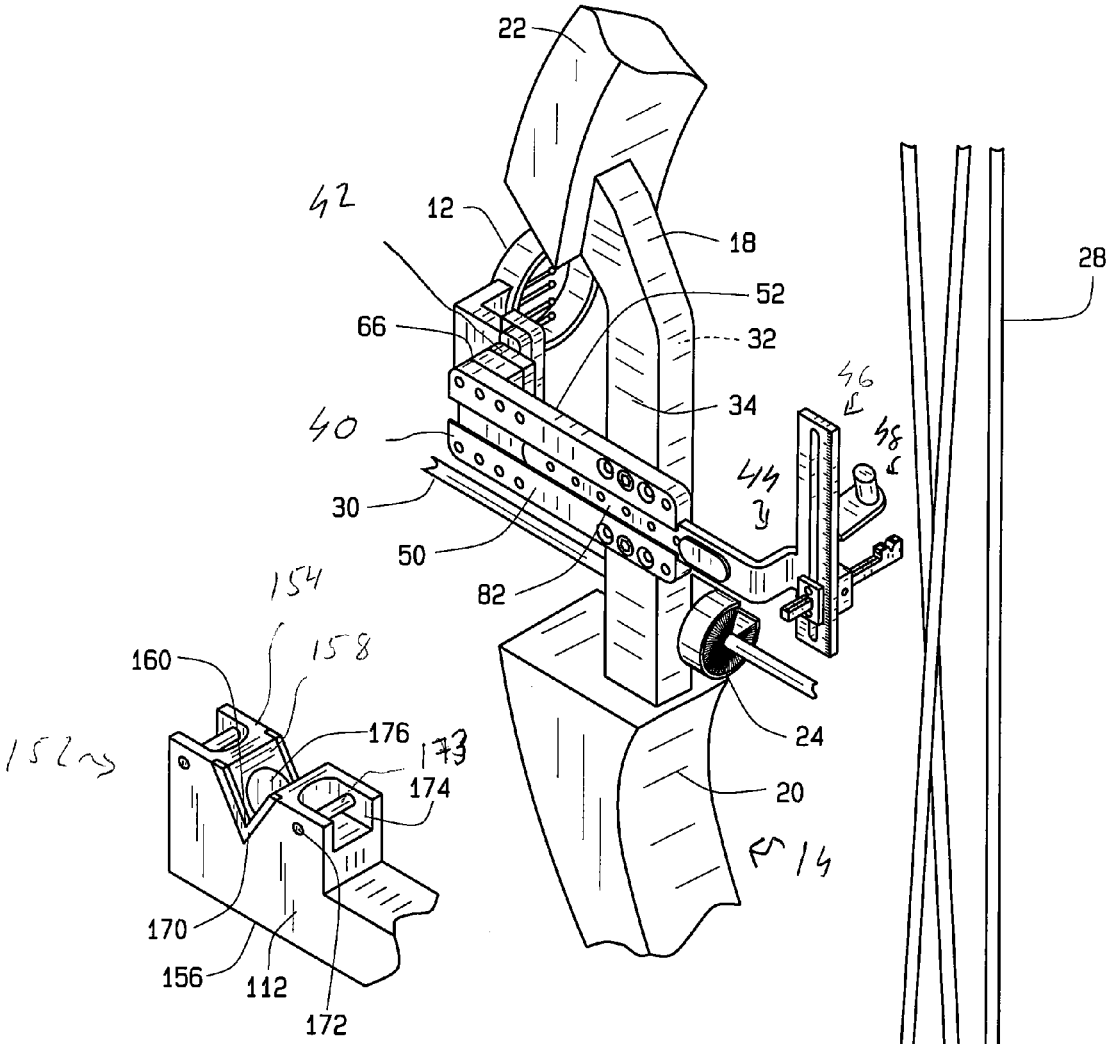
FIG. 7 is a partial perspective view of the sight of FIG. 6 connected to a riser of the compound bow.
FIG. 8*a* is a partial perspective view of the sight guide, fiber optic strands and reflective channels.

Turning to FIGS. 1, 4 and 7, the sight 10 of the present disclosure may be suitably used in combination with a forward sight 12 that is mounted in a forward position of a compound bow 14. FIGS. 1 and 4 illustrates a bow for right handed shooting while FIG. 7 illustrates a bow for left handed shooting. The forward sight 12 can have one or several pins 16 (FIGS. 4 and 7) that define a point in space forward of the bow 14. Turning to FIG. 1, the bow 14 includes a riser 18 and a handle 20 disposed within the riser 18. The riser 18 is the central mount for other bow 14 components such as limbs 22 and an arrow rest 24. The bow 14 positions a horizontal axis denoted "X" along the riser 18 and a vertical axis denoted "Y".

The limbs 22 extend outward from the riser 18 along the vertical axis "Y" to position pulleys 26 at ends of the limbs 22.

A string 28 of the bow 14 attaches to the pulleys 26, one or both of which has one or more cables attached to the opposite pulley 26. The string 28 attaches to the pulleys 26 at locations rearward of the riser 18 toward the archer (not shown) when the archer is holding the bow 14 for use. The arrow rest 24 is positioned adjacent to the riser 18 and above the handle 20. The arrow rest 24 supports an arrow 30 having a direction of flight along the horizontal axis "X". When the archer draws the string 28 back along the horizontal axis "X", the string 28 causes the pulleys 26 to turn. This string movement causes the pulleys 26 to pull the cables, which in turn causes the limbs 22 to bend and thus store potential energy. When the archer releases the string 28, this potential energy is converted to kinetic energy to move the arrow 30 forward from the arrow rest 24 along the horizontal axis "X".

As shown in the drawings, the riser 18 has an inner side 32 oriented toward the arrow rest 24 and has an outer side 34 positioned opposite of the arrow rest 24. Inner side 32 and outer side 34 join together at a forward side 36 and a rearward side 38 as measured along the horizontal axis "X".

The sight 10 comprises a mounting bracket 40, a forward sight positioner 42, a rear sight positioner 44, a sight assembly 46 and a light assembly 48. The mounting bracket 40 and rear sight positioner 44 are configured for selective choosing by the archer to use an aiming eye of the archer in conjunction with an oppositely matched shooting hand. In particular, the sight 10 allows the archer to manipulate the rear sight positioner 44 for left eye/right hand or right eye/left hand handling of the bow 14 for subsequent alignment of the sight 10 with the forward sight 12.

Referring to FIGS. 1-4, the sight 10 is described for use by a left eye/right hand archer. For a right hand archer, the arrow rest 24 is positioned on the inner side 32 of the riser 18 as shown in FIGS. 1 and 4. The mounting bracket 40 of the present sight 10 has a first side 50, a second side 52, a top side 54, a bottom side 56, a front edge 58 and a rear edge 60. The first side 50 and second side 52 have a length as measured between the front edge 58 and the rear edge 60 from about 4½" to about 6½". In an embodiment, the length is about 5½". The first side 50 and the second side 52 have a height as measured between the top side 54 and the bottom side 56 from about one inch to about 3". In an embodiment, the height is about 1¾".

Figure 2:
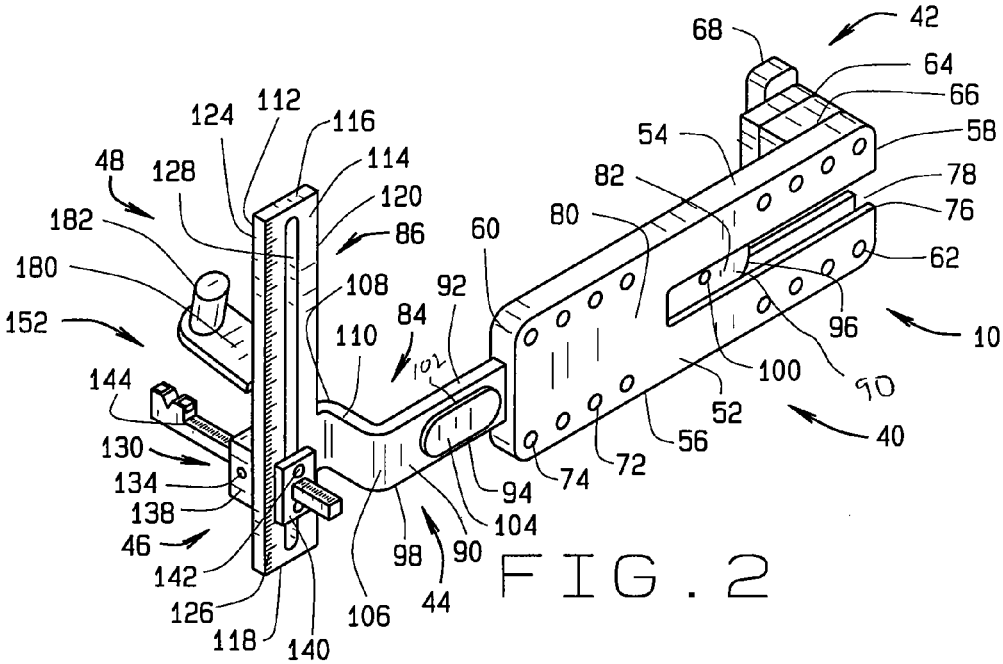
FIG. 2 illustrates a right perspective view of the sight for a left eye/right-handed archer illustrating a mounting bracket, a forward sight positioner a rear sight positioner, a sight holder and sight assembly constructed in accordance and embodying the present disclosure.
Figure 3:
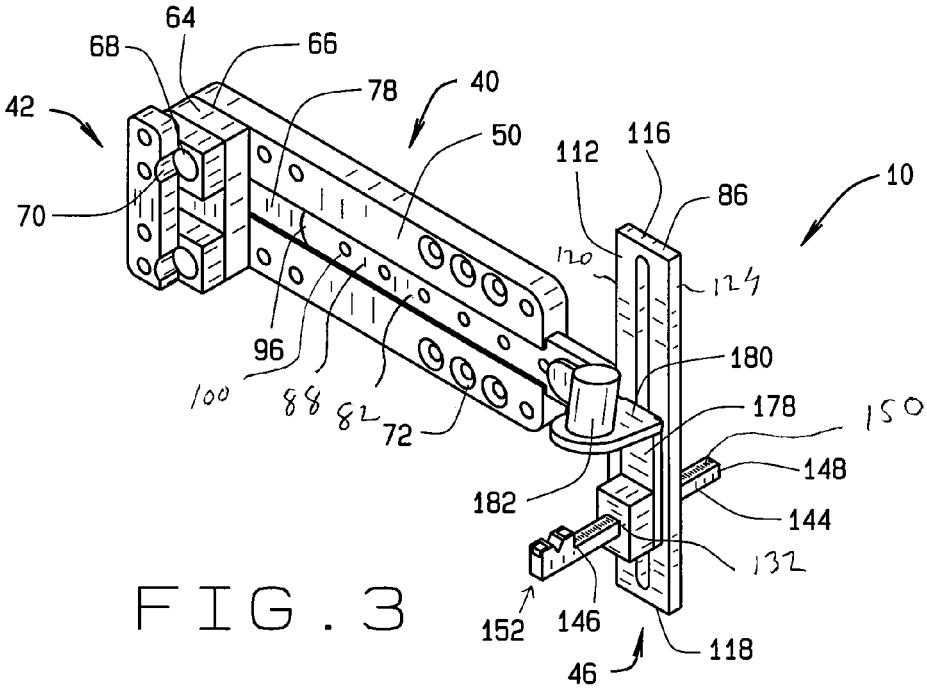
FIG. 3 illustrates a left perspective view of the sight of FIG. 2.

Turning to FIGS. 2 and 3, a pair of apertures 62 extends through the first side 50 and the second side 52. Apertures 62 are positioned near the front edge 58. The apertures 62 are configured to removably connect with the forward sight positioner 42 via fasteners, such as set screws. In an embodiment, multiple pairs of apertures 62, for mounting the forward sight positioner 42 relative to the mounting bracket 40, extend from the front edge 58 toward the rear edge 60. For illustrative purposes only, four pairs of apertures 62 are shown extending through the front side and the second side 52 along the mounting bracket 40.

The forward sight positioner 42 includes a body 64 having mounting side 66 and a sight side 68. Between the mounting side 66 and the sight side 68, the body 64 can have a length from about 0.5 inches to 2 inches. In an embodiment, the body 64 has a length of about 1 inch. The body 64 may comprise one integral piece. Alternatively, the body 64 may comprise multiple pieces to accommodate a variety of lengths for the body 64. The mounting side 66 removably connects to the first side 50 of the mounting bracket 40 via fasteners inserted into apertures 62 of the mounting bracket 40. The sight side 68 has receiving apertures for removably connecting to the forward sight 12 (FIGS. 1 and 4). The forward sight positioner 42 spaces the forward sight 12 from the mounting bracket 40 on the same side of the riser 18 as the arrow rest 24. The sight side 68 is configured to accept a variety of forward sites 12 such as a "Copper John" ™ site. In an embodiment, the sight end 68 includes cutouts 70 to match with mounting components for a variety of forward sights 20.

Another pair of apertures 72 extend through the first side 50 and the second side 52. These apertures 72 are positioned near the rear edge 60 and are configured to connect the mounting bracket 40 to the outer side 34 (FIG. 4) of the riser 18 of the bow 14. In an embodiment, multiple pair of apertures 72 for mounting to the riser 18 of the bow 14 extend from the rear edge 60 toward the front edge 58. For illustrative purposes only, three pair of apertures are shown extending through the first side 50 and the second side 52. Apertures may be countersunk to allow the archer to remove the sight 10 and reinstall the sight without having to make any sight adjustments. This allows for same consistent accuracy during shooting. A final pair of apertures 74 extends through the first side 50 and the second side 52. Apertures 74 are positioned near the rear end 98 and are configured to connect with a quiver (not shown).

The plurality of apertures 72 align the mounting bracket 40 to be mounted on the riser 18, via fasteners (not shown), in a manner that permits adjustable movement of the mounting bracket 40 to the riser 18. By selecting a desired pair of apertures 72, the archer connects the mounting bracket 40 to a preferred location on the riser 18. In particular, the pair of apertures 72 allow the mounting bracket 40 to move along the horizontal axis "X" of the riser 18 with respect to the forward side 36 and the rearward side 38 of the riser 18. For connecting the mounting bracket 40 for the riser 18, the archer inserts fasteners through a selective pair of apertures 72 and into receiving holes on the riser 18. The archer mounts the mounting bracket 40 to the riser 18 such that the first side 50 of the mounting bracket 40 contacts the outer side 34 of the riser 18. In this orientation, the mounting bracket 40 is positioned on the opposite side of the riser 18 from the arrow rest 24 (FIGS. 1 and 4).

The first side 50 and second side 52 of the mounting bracket 40 include a pair of oppositely spaced channels 76. The channels 76 extend generally from the rear edge 60 toward the front edge 58 and generally between the aperture pairs 62, 72. The channels 76 form a slot 78 within the first side 50 and the second side 52. The channels 76 are configured open at the rear edge 60 and are partially open at the front edge 58. Additionally, the slot 78 is fully exposed on the first side 50 (FIG. 3) between the rear edge 60 and the front edge 58. The second side 52 includes a sidewall 80 (FIG. 2) that extends between the apertures 72 and extends from the rear edge 60 to about a distance about half way toward the front edge 58 to partially expose the slot 78.

Turning to FIG. 2, the rear sight positioner, generally shown as 44, includes a slide 82, an offset member 84 and a sight holder 86. The offset member 84 connects together the slide 82 and the sight holder 86 in an offset orientation. In an embodiment, the offset member 84 integrally connects to the slide 82 and to sight holder 86. The slide 82 is configured to be removably insertable within the slot 78 of the mounting bracket 40. This movement of the slide 82 within the slot 78 permits the offset member 84 and sight holder 86 to move horizontally in the direction of the mounting bracket 40.

The slide 82 has a first side 88, a second side 90, a top side 92, a bottom side 94, a front end 96 and a rear end 98. The first side 88 and second side 90 have a length as measured between the front end 96 and the rear end 98 from about 3½" to about 5½". In an embodiment the length is about 4½". The first side 50 and the second side 52 have a height as measured between the top side 92 and the bottom side 94 from about one-half inch to about one inch. In an embodiment, the height is about three-quarter inches.

The slide 82 includes a plurality of apertures 100 extending through the first side 88 and second side 90. Apertures 100 are evenly spaced starting from the front end 96. Each aperture 100 is configured to receive a fastener (not shown) such as a set screw. The fastener can be used to set the slide 82 in place relative to the slot 78 of the mounting bracket 40. At a desired position of the slide 82 within the slot 78, the archer inserts the fastener through the aperture 100 and in contact with the sidewall 80 to hold the slide 82 in the slot 78 at the desired position.

The slide 82 further includes an elongated slot 102 that extends within the first side 88 and second side 90 and generally extends between the rear end 98 and last of the apertures 100. The slot 102 has a length from about 0.5 inches to about 1.25 inches and a height from about ⅛ inches to about 0.5 inches. The elongated slot 102 is configured to accept and to hold a vibration damper 104 such as, but not limited to, a rubber grommet.

As noted, the offset member 84 spaces the sight holder 86 from the slide 82. The offset member 84 has a length as measured between the slide 82 and sight holder 86 of about ¼ inch to about one inch. In an embodiment, the length of the offset member 84 is about ¾ inches. The offset member 84 includes a first bend 106, a second bend 108 and a body 110 disposed therebetween. The first bend 106 connects to the rear end 98 of the slide 82 such that the first bend 106 extends angularly beyond from the first side 88 of the slide 82 in a direction opposite of the second side 90 of the slide 82. In an embodiment, the first bend 106 angles about 90 degrees from the rear end 98 of the slide 82 to position the body 110 at a generally perpendicular angle to the slide 82. The second bend 108 angularly bends beyond the body 110 in a direction that is co-planar with the slide 82. In an embodiment, the second bend 108 angles about 90 degrees from the body 110. The second bend 108 connects with the sight holder 86 such that the sight holder 86 lies in a plane orientated generally parallel to the plane of the slide 82.

The sight holder 86 has a first side 112, a second side 114, a top side 116, a bottom side 118, a front end 120 and a rear end 124. The front end 120 integrally connects with the end of the second bend 108 of the offset member 84. In an embodiment, the second bend 108 connects to the front end 120 at a location closer to the bottom side 118 than the top side 116 of the sight holder 86.

The first side 112 and second side 114 of the sight holder 86 have a length as measured between the front end 120 and the rear end 124 from about ½ inch to about ¾ inch. The first side 112 and the second side 114 have a height as measured between the top side 116 and the bottom side 118 from about four and a half inches to about one inch. The second side 114 also includes indicia 126 that extend from about the top side 116 to the bottom side 118. The indicia 126 are positioned on the second side 114 near the rear end 124 of the sight holder 86. The indicia 126 represent markings to set the sight assembly 46. The sight holder 86 further includes an elongated slot 128 disposed between the first side 112 and the second side 144. As shown, the slot 128 extends between the top side 116 and the bottom side 118 along a vertical axis of the sight holder 86.

The sight assembly, generally shown as 46, mounts on the sight holder 86 in a manner that permits adjustable movement of the sight assembly 46 on the sight holder 86. The sight assembly 46 may be adjustably movable on and with respect to the sight holder 86 in directions that are perpendicular to the vertical axis of the sight holder 86. This movement along the vertical axis of the sight holder 86 permits adjustment of the sight assembly 46 in a vertical direction with respect to the riser 18 of the bow 14. The sight assembly 46 may also be movable in a plane that is oriented perpendicular to the vertical axis of the sight holder 86 to permit adjustment of the orientation of the sight 10 in a lateral direction with respect to the riser 18 of the bow 14.

The sight assembly 46 includes a pedestal, generally shown as 130, that is slidably mounted on the slot 128 of the sight holder 86. The pedestal 130 has a channel 132 formed therein, and the channel 132 may extend substantially perpendicular to the vertical axis defined by the sight holder 86. A set screw set hole 134 may be formed in the pedestal 130 and may be in communication with the channel 132, and a set screw may be positioned in the set screw hole 132 such that rotation of the set screw in a first direction moves the set screw inwardly with respect to the pedestal 130.

The pedestal 130 also includes an anchor member 138 that is positioned adjacent to the first side 112 of the sight holder 86. The pedestal 130 further includes a backing plate 140 that is positioned adjacent to the second side 114 of the sight holder 86 at a location that is opposite of the anchor member 138. As shown, the slot 128 of the sight holder 86 is positioned between the anchor 138 and the backing plate 140. The channel 132 extends through the anchor member 138 and through the backing plate 140. The pedestal 130 may also include at least one fastener 142, and preferably includes a pair of fasteners that connect the backing plate 140 to the anchor 138 across the slot 128. The pedestal 130 is adjustably moveable upward and downward with respect to the slot 128 of the sight holder 86.

The sight assembly 46 includes a mast member 144 that is mounted on the pedestal 130. The mast member 144 includes a first end 146, second end 148 and indicia markings 150 (FIG. 3) between the first end 146 and the second end 148 to align the sight assembly 46. The indicia markings 150 assist in setting the mast member 144. The second end 148 of the mast member 144 may be positioned in the channel 132 of the pedestal 130. The mast member 144 extends within the channel 132 to insert through the anchor 138 and through the slot 128 of the sight holder 86. The mast member 144 continues through the slot 128 and through the channel 132 of the backing plate 140. The mast member 144 is adjustably movable inward and outward with respect to the channel 132. In particular, set screw is selectively abbuttable against the mast member 144 that is positioned in the channel 132 for securing a position of the mast member 144 with respect to the pedestal 130. Since the mast member 144 is adjustably movable with respect to the channel 132, the mast member 144 is laterally adjustable with respect to the sight holder 46.

Figure 8:
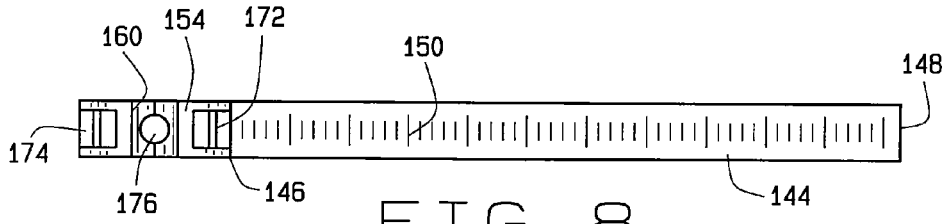
FIG. 8 is a plan view of the sight guide and mast of the sight assembly.

Turning to FIGS. 8 and 8*a*, the sight assembly 46 also includes a sight guide 152 that is mounted on the mast member 144, and the sight guide 152 has a top 154 for orienting upwardly and a bottom 156 for orienting downwardly when the sight mounts on bow 14. The sight guide 152 includes a sight groove 158 that is formed therein, and the sight groove 158 may have a substantial V-shaped cross section to form a V-shaped notch 160. A V-shaped indicia 170 outlines the V-shaped notch 160. The sight groove 158 extends from the top 154 of the sight guide 152 toward the bottom 156 of the sight guide 152. The thickness of the sight groove 158, from front to back, should be sufficient to assure that the archer's view through the groove is substantially parallel to the plane of the horizontal axis "X". If the bow 14 is turned relative to the archer about vertical axis "Y", the archer will not be able to see a pin of the forward sight. Additionally, turning the bow relative to the archer about the vertical axis "Y", the pin of the front sight will become obscured if the archer does not have their head in the exact position as when the archer sighted the bow. The sight guide is configured to minimize or eliminate alignment mistakes before shooting the arrow.

In general, the greater the thickness of the sight guide 152 and the greater the distance between the groove 158 and the forward sight 12, the greater will be the accuracy of the arrangement. The sight groove 158 has a length, a width and a height such that the length has a longer dimension than the width. The height and the width of the sight groove 158 are uniform along the length of the sight groove wherein the length is along the horizontal axis "X" that is parallel to flight of the arrow 30.

The sight guide 152 includes a pair of alignment marks 172 that are marked on the sight guide 152. Each alignment mark 172 comprise a dot and the dots may be located on opposite sides of the sight groove 158. The alignment dots 172 may be located adjacent to the top 154 of the sight guide 152 and can be painted with highly reflective or florescent paint. In an embodiment, the alignment dots 172 comprise fiber optic strands 173 to aid the archer in low light conditions. The alignments dots 172 can comprise a member that glows in low light conditions.

The sight guide 152 also includes open channels 174 positioned on opposite sides of the V-shaped notch 160. The channels 174 open upwardly to surround portions of the fiber optic strands. Each channel 174 includes a reflective coating or a polished coating that reflects light toward the fiber optics to enhance the glow of the fiber optics. In an embodiment, the channels 174 are U-shaped and extend from the top of the sight guide 152 and into the sight guide 152.

The V-shaped notch 160 further includes an aperture 176 at the bottom of the V-shaped notch 160 that proceeds through the sight guide 152 to communicate with the bottom 156 of the sight guide 152. The aperture 176 is configured to drain liquid such as rain water or condensation that can buildup in the V-shaped notch 160. Any liquid build up minimizes the viewing area of the V-shaped notch 160. Accordingly, the aperture 176 drains the water out of the V-shaped notch 160.

Referring to FIGS. 1-4, the light assembly 48 is shown mounted on the sight holder 86 for illuminating the V-notch indicia 170, the alignment marks 172, and the fiber optic strands 173. The light assembly 48 is mounted between the anchor 138 and the first side 112 of the sight holder 86. The light assembly 48 includes a first bracket 178 and a second bracket 180. In an embodiment, the first bracket 178 and the second bracket 180 are integral with each other. The second bracket 180 angularly extends from the first bracket 178. In an embodiment, the second bracket 180 angles about 90° from the first bracket 178. In this arrangement, the second bracket 180 suspends over and above the sight guide 152.

The second bracket 180 includes a light 182. The light 182 can be battery powered and can operate at a frequency that will not distract the archer and yet one that will cause the alignment marks 172 or the V-notch indicia 170 or the fiber optic strands 173 to glow visibly. In an embodiment, the light illuminates the coated or polished channels 174. The channels 174 reflect the light toward the fiber optic strands to enhance the visibility at the strands 173 and the alignment marks 172.

Turning to FIGS. 1 and 4 and referring to FIGS. 2 and 3, during use of the sight, the left-eye/right handed archer will removably connect the forward sight positioner 42 to the first side 50 of the mounting bracket 40. The archer then selectively places the first side 50 of the mounting bracket 40 against the outer side 34 of the riser 18 for the right handed bow 14. In this arrangement, the mounting bracket 40 is positioned on the opposite side of the riser 18 as the arrow rest 24. Further, in this arrangement, the sight side 68 of the forward sight positioner 42 is orientated forward of the riser 18 but facing the riser 18. The archer can removably connect the forward sight 12 to the forward sight positioner 42 to position the forward sight 12 in the same plane as the inner side 32 of the riser 18 and in front of the arrow rest 24.

The archer can also assemble the sight assembly 46 to the sight holder 86. The archer inserts the free end of the mast 144 through the pedestal 130, via channel 132, and through the first bracket 178 of the light assembly 48. The archer continues to insert the mast 144 through the slot 128 of the sight holder 86 and through the back plate 140. The archer can insert fasteners to secure the mast member 144 within the anchor 138 and to secure the backing plate 140 to the anchor 138.

With the sight assembly 46 connected to the sight holder 86, the archer inserts the front edge 58 of the slide 82 into the slot 78 of the mounting bracket 40. Since the first bend 106 of the offset member 84 angles perpendicularly toward the plane of the inner side 32 of the riser 18, the sight holder 86 is co-planerly aligned with the riser 18. The mast 144 extends outwardly from the pedestal 130 to position the sight guide 152 beyond the inner side 32 of the riser 18 and behind the riser 18.

In this arrangement, the archer can move the sight guide 152 along three degrees of movement. First, the archer can move the slide 82 forward and backward within the slot 78 of the mounting bracket 40. This movement in plane with the horizontal axis "X" of the riser 18 provides for horizontal or longitudinal movement of the sight guide 152 with respect to the forward sight 12. Second, the archer moves the pedestal 130 upwardly and downwardly with respect to the sight 12. This movement is in plane with the longitudinal axis "Y" of the riser 18 provides for vertical movement of the sight guide 152 with respect to the forward sight 12. Third, the archer can move the mast 144 inwardly and outwardly with respect to the sight holder 86. This movement permits lateral displacement with respect to the forward sight 12.

Through the three degrees of movement of the sight guide 152, the archer can selectively position and align the V-notch 160 groove with the forward sigh 12. The archer can selectively align the V-notch 160 groove of the sight guide 152 by fastening the slide 82 at a desired position within the slot 78 of the mounting bracket 40; by fastening the backing plate 140 to the sight holder 86 and by fastening the mast 144 to the anchor 138. The indicia markings 126 on the first side 112 of the sight holder 86 and on the mast assist 144 the archer in setting the sight guide 152 in alignment with the forward sight 12.

For an archer who was a right eye/right handed shooter; but through a condition to the right eye, is now a left eye/right handed shooter, the present sight allows the archer to keep his bow 14 and remain shooting. The archer can mount the mounting bracket 40 of the present sight to the right-handed bow 14 to position the sight guide 152 and forward sight 12 for aiming with the archer's left eye. As shown, the forward sight positioner 42 and the offset member 84 align the sight guide 152 and the forward sight 12 with the archer's left eye.

Figure 5:
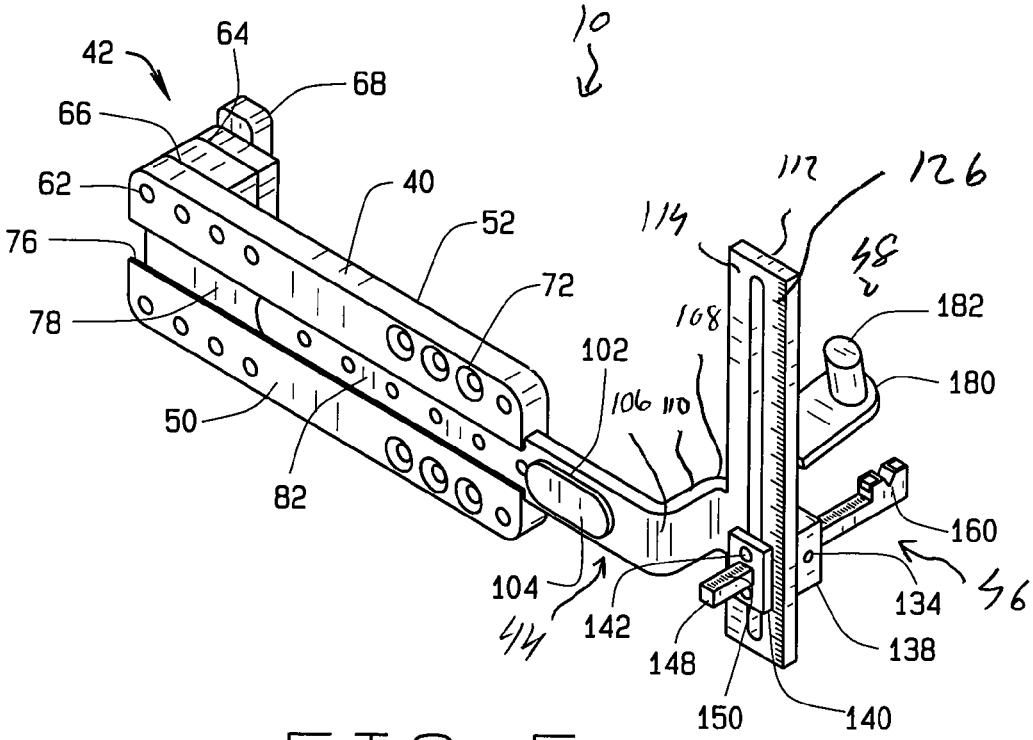
FIG. 5 illustrates a right perspective view of the sight for a right eye/left-handed archer illustrating a mounting bracket, a forward sight positioner a rear sight positioner, a sight holder and sight assembly constructed in accordance and embodying the present disclosure.
Figure 6:
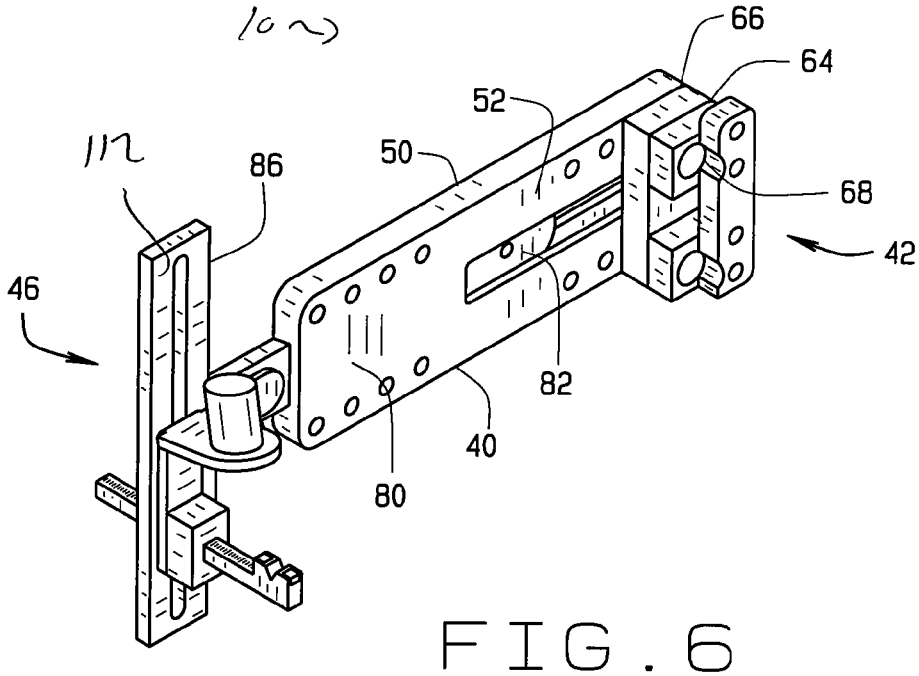
FIG. 6 illustrates a left perspective view of the sight of FIG. 5.

Referring to FIGS. 5-7, the sight 10 is described for use by a right eye/left hand archer. For a left hand archer, the arrow rest 24 is positioned on the inner side 32 of the riser 18 as shown in FIG. 7. The components of the sight 10 for the left handed bow 14 (FIG. 7) are the same components of FIGS. 1-4 and 8, 8*a* and like components will have the same element numbers. The orientation of the components for the sight 10 of FIGS. 5-7, however, is different than the orientation of FIGS. 1-4.

Turning to FIGS. 5-6, the forward sight positioner 42 removably connects to the second side 52 of the mounting bracket 40. In particular, the mounting side 66 of the forward sight positioner 42 connects to apertures 66 of the second side 52. Additionally, the second side 52 of the mounting bracket 40 connects to the outer side 34 of the riser as shown in FIG. 7.

Referring to FIGS. 5-7, during use of the sight, the right-eye/left handed archer will removably connect the forward sight positioner 42 to the second side 52 of the mounting bracket 40. The archer then selectively places the second side 52 of the mounting bracket 40 against the outer side 34 of the riser 18 for the left handed bow 14. In this arrangement, the mounting bracket 40 is positioned on the opposite side of the riser 18 as the arrow rest 24. Further, in this arrangement, the sight side 68 of the forward sight positioner 42 is orientated forward of the riser 18 but facing the riser 18. The archer can removably connect the forward sight 12 to the forward sight positioner 42 to position the forward sight 12 in the same plane as the inner side 32 of the riser 18 and in front of the arrow rest 24.

The archer can also assemble the sight assembly 46 to the sight holder 86 as previously discussed. With the sight assembly 46 connected to the sight holder 86, the archer inserts the front edge 58 of the slide 82 into the slot 78 of the mounting bracket 40. Since the first bend 106 of the offset member 84 angles perpendicularly toward the plane of the inner side 32 of the riser 18, the sight holder 86 is co-planerly aligned with the riser 18. The mast 144 extends outwardly from the pedestal 130 to position the sight guide 152 beyond the inner side 32 of the riser 18 and behind the riser 18.

In this arrangement, the archer can move the sight guide 152 along three degrees of movement. First, the archer can move the slide 82 forward and backward within the slot 78 of the mounting bracket 40. This movement in plane with the horizontal axis "X" of the riser 18 provides for horizontal or longitudinal movement of the sight guide 152 with respect to the forward sight 12. Second, the archer moves the pedestal 130 upwardly and downwardly with respect to the sight 12. This movement is in plane with the longitudinal axis "Y" of the riser 18 provides for vertical movement of the sight guide 152 with respect to the forward sight 12. Third, the archer can move the mast 144 inwardly and outwardly with respect to the sight holder 86. This movement permits lateral displacement with respect to the forward sight 12.

For an archer who was a left eye/left handed shooter; but through a condition to the left eye, is now a right eye/left handed shooter, the present sight allows the archer to keep his bow and remain shooting. The archer can mount the mounting bracket 40 of the present sight to the left-handed bow to position the sight guide 152 and forward sight 12 for aiming with the archer's right eye. As noted, the forward sight positioner 42 and the offset member 84 align the sight guide 152 and the forward sight 12 with the archer's right eye.

Figure 9:
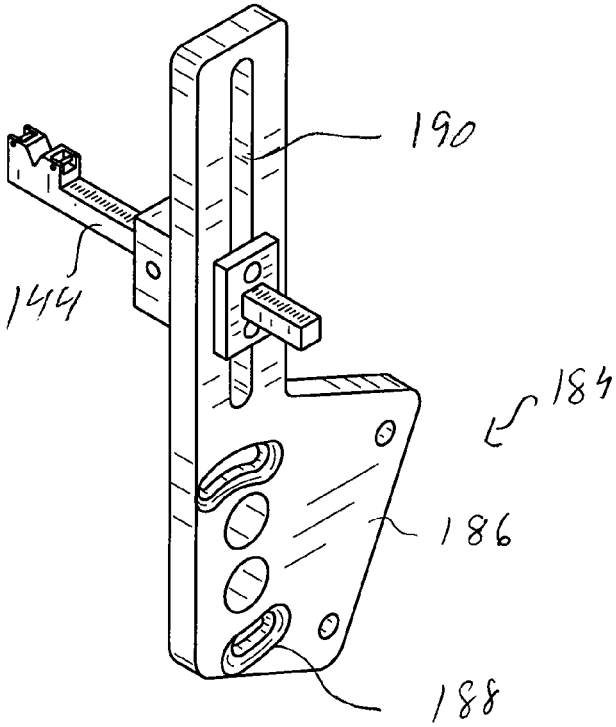
FIG. 9 is right side perspective view of a bracket configured to hold the sight assembly.
Figure 10:
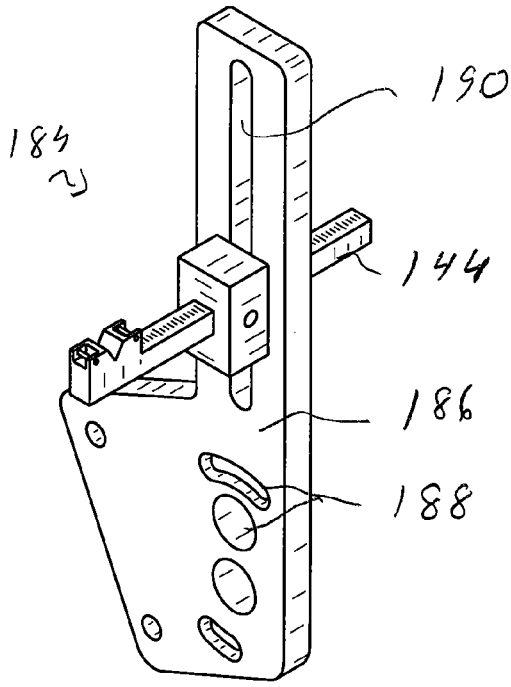
FIG. 10 is a left side perspective view of the bracket of FIG. 9.

FIGS. 9 and 10 illustrate an alternative embodiment for the rear sight positioner 184. Certain bows (not shown), such as those sold under the mark "Liberty 1" by Liberty Archery utilize a different design than standard compound bows. The design for these types of bows eliminates a heavy riser. These bows use an "A-frame" structure via separated limbs to shoot the arrow through the limbs. The bow also uses large cams.

The rear sight positioner 184 includes a bracket 186 that is removably connectable to the A-frame structure. The bracket 186 includes adjustable mounting apertures 188 to connect to the bow and includes a slot 190 to adjustably receive the mast 144 as previously described.

In view of the above, it will be seen that the several objects of the disclosure are achieved and other advantageous results are obtained. As various changes could be made in the above constructions without departing from the scope of the disclosure, it is intended that all matter contained in the above description or shown in the accompanying drawings shall be interpreted as illustrative and not in a limiting sense.

The invention claimed is:

1. A rear sight for use in conjunction with a forward pin sight on a bow, the sight comprising:

a mounting bracket removably connected to the bow, the mounting bracket being elongated in a longitudinal direction and having a longitudinal axis, the mounting portion having a slot in the longitudinal direction;

a rear sight positioner removably connected to the mounting bracket, the rear sight positioner having a slide outwardly extending toward the mounting bracket, the slide being removably insertable within the slot such that the support portion is transversely movable from the mounting portion along the longitudinal direction, the rear sight positioner having an offset member oriented toward the bow; and a sighting assembly having a sight groove, the sight groove extending along an axis oriented substantially parallel to the plane of the support portion, the sighting assembly being mounted on the offset member in a manner so that the sighting assembly is adjustably movable along three axis of movement relative to the bow, the sight groove having a length, a width and a height such that the length has a longer dimension than the width, the height and the width of the sight groove being uniform along the length of the sight groove wherein the length is along the longitudinal axis that is parallel to flight of an arrow, wherein the offset member positions the sight guide in apposition for aiming with the archer's non-dominant eye and with the forward sight.

2. The sight of claim 1 additionally comprising a bow string mounted thereon, the sighting assembly being mounted on the bow in a position rearward of the bow toward the string for orienting toward an archer when the archer draws the bow string of the bow.

3. The sight of claim 1 wherein the sighting assembly is mounted to the offset member along an axis that is substantially perpendicular to the plane of the rear sight positioner to permit adjustment of the position of the sight groove of the sighting assembly in a horizontal direction, the sighting assembly is further mounted to the offset member in a plane that is oriented substantially perpendicular to the longitudinal axis of the mounting bracket to permit adjustments of the sight groove in a vertical direction and to permit adjustment of the position of the sight groove of the sighting assembly in a transverse direction relative to the mounting bracket to adjust the distance between the sight groove and the forward pin sight assembly

4. The sight of claim 1 wherein the sighting assembly comprises: a pedestal slidably mounted on the rear sight positioner and having a channel formed therein; a mast member mounted on the pedestal with an end portion of the mast member being positioned in the channel of the pedestal such that a position of the mast member in the channel is adjustable, the sight groove being mounted on the mast member.

5. The sight of claim 4 wherein the sight groove has a substantially V-shaped cross section, the sight groove being located near a top edge of a sight guide.

6. The sight of claim 5 additionally comprising a pair of alignment marks on the sight guide, each of the alignment marks being located on an opposite side of the sight groove and located between a top of the height of the sight groove and a bottom of the height of the sight groove.

7. The sight of claim 6 wherein the alignment marks comprises fiber optic strands.

8. The sight of claim 7 wherein the sight guide includes polished channels positioned partially around the fiber optic strands.

9. The sight of claim 8 additionally comprising a light assembly being positioned over the channels to light the fiber optic strands such that the channels reflect light toward the fiber optic strands.

10. The sight of claim 1 wherein the mounting bracket is separately movable with the forward sight.

* * * * *